US008371670B2

(12) United States Patent
Okazaki

(10) Patent No.: US 8,371,670 B2
(45) Date of Patent: Feb. 12, 2013

(54) LIQUID DROPLET JETTING APPARATUS

(75) Inventor: Naoya Okazaki, Gifu-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 246 days.

(21) Appl. No.: 12/723,907

(22) Filed: Mar. 15, 2010

(65) Prior Publication Data

US 2010/0231630 A1 Sep. 16, 2010

(30) Foreign Application Priority Data

Mar. 16, 2009 (JP) ..... 2009-063242

(51) Int. Cl.

| | |
|---|---|
| ***B41J 29/38*** | (2006.01) |
| ***B41J 29/393*** | (2006.01) |
| ***B41J 2/165*** | (2006.01) |
| ***B41J 2/14*** | (2006.01) |
| ***B41J 2/175*** | (2006.01) |

(52) U.S. Cl. ..... 347/14; 347/19; 347/30; 347/47; 347/85

(58) Field of Classification Search ..... None
See application file for complete search history.

(56) References Cited

U.S. PATENT DOCUMENTS

| | | | | |
|---|---|---|---|---|
| 6,517,182 | B1 * | 2/2003 | Scardovi | 347/19 |
| 6,631,973 | B1 * | 10/2003 | Edamura | 347/30 |
| 6,736,482 | B1 | 5/2004 | Suzuki | |
| 6,932,458 | B2 * | 8/2005 | Howkins et al. | 347/47 |
| 2005/0264609 | A1 | 12/2005 | Kubo et al. | |

FOREIGN PATENT DOCUMENTS

| | | |
|---|---|---|
| JP | 8108532 | 4/1996 |
| JP | 9-011494 | 1/1997 |
| JP | 2001-180010 | 7/2001 |
| JP | 2005-335132 | 12/2005 |
| JP | 2007283688 | 11/2007 |

* cited by examiner

*Primary Examiner* — Stephen Meier
*Assistant Examiner* — Alexander C Witkowski
(74) *Attorney, Agent, or Firm* — Frommer Lawrence & Haug LLP

(57) ABSTRACT

A liquid droplet jetting apparatus which jets liquid droplets of a liquid onto a recording medium includes: a jetting head having a channel unit in which a plurality of nozzles for jetting the liquid droplets and a plurality of pressure chambers communicating with the nozzles respectively are formed, and a pressure applying section which applies a pressure to the liquid inside the pressure chambers; and a controller having a pressure calculating section which calculates a pressure in the channel unit, and controlling the pressure applying section to execute: a duty limiting in which a jetting amount of the jetting head for a predetermined time period is limited to a first jetting amount when the pressure in the channel unit calculated by the pressure calculating section satisfied a predetermined condition; and a flushing in which the pressure applying section is driven irrespective of a jetting operation onto the recording medium.

9 Claims, 6 Drawing Sheets

LIQUID DROPLET JETTING APPARATUS

CROSS REFERENCE TO RELATED APPLICATION

The present application claims priority from Japanese Patent Application No. 2009-063242, filed on Mar. 16, 2009, the disclosure of which is incorporated herein by reference in its entirety.

BACKGROUND OF THE INVENTION

1. Field of the Invention

The present invention relates to a liquid droplet jetting apparatus such as an ink-jet printer.

2. Description of the Related Art

As an ink-jet printer, an ink-jet printer which includes a jetting head having a channel unit in which a plurality of nozzles and channels are formed, and a piezoelectric actuator which selectively applies a jetting pressure to an ink in the channel unit, has hitherto been known (For example, refer to Japanese Patent Application Laid-open No. 2007-283688). The channel unit is provided with ink inflow ports corresponding to ink colors respectively for taking inks from ink cartridges into the channels, and filters for eliminating foreign matters are attached to these ink inflow ports. Moreover, channels between the ink inflow ports and the plurality of nozzles communicate with each other for each of the ink colors. When the ink is jetted from the nozzle, a negative pressure is generated in the channels at the interior of the channel unit due to a decrease of the ink inside the channel unit, and due to the negative pressure, the ink is sucked from the ink cartridge through the ink inflow port, and refilled (replenished).

SUMMARY OF THE INVENTION

Incidentally, in ink-jet printers of recent years, in order to facilitate speeding up of printing, there is a tendency of an increase in the number of nozzles formed in the jetting head. When the number of nozzles is large, an amount of ink jetted per unit time becomes large, and the negative pressure due to jetting increases. In this manner, when the negative pressure generated by jetting once becomes substantial, the subsequent jetting starts before the negative pressure generated by the jetting is cancelled by refilling, and the negative pressure increases cumulatively. Besides, when a flow resistance of the ink increases because of an increase in an ink viscosity due to a decrease in a temperature, the negative pressure which increases cumulatively becomes more substantial. Moreover, when the increased negative pressure surpasses a certain threshold value, there occurs an under refilling phenomenon in which the amount of ink refilled to the channels in the channel unit becomes insufficient. When the under refilling phenomenon occurs, a meniscus of ink in a nozzle is destroyed and it is not possible to carry out a normal jetting in some cases.

Therefore, when a predetermined limiting condition such as two conditions or one of two conditions namely, the temperature becomes lower than the threshold value, and a situation in which the number of nozzles jetting is large continues for a long time is satisfied, it can be considered executing a duty limiting function, for example providing a waiting time during printing, and limiting an amount of ink to be jetted per predetermined time. However, when the duty limiting function is executed, since a recording operation is delayed as a whole, an original object of speeding up of printing is impaired.

Therefore, an object of the present invention is to suppress a decrease in a recording speed while preventing an occurrence of the under refilling phenomenon.

The present invention is made in view of the abovementioned circumstance. According to a first aspect of the present invention, there is provided a liquid droplet jetting apparatus which jets liquid droplets of a liquid onto a recording medium, including: a jetting head having a channel unit in which a plurality of nozzles for jetting the liquid droplets and a plurality of pressure chambers communicating with the nozzles respectively are formed, and a pressure applying section which applies a pressure to the liquid inside the pressure chambers; and a controller having a pressure calculating section which calculates a pressure in the channel unit, and controlling the pressure applying section to execute: a duty limiting in which a jetting amount of the jetting head for a predetermined time period is limited to a first jetting amount when the pressure in the channel unit calculated by the pressure calculating section satisfied a predetermined condition; and a flushing in which the pressure applying section is driven irrespective of a jetting operation onto the recording medium, and when the flushing is to be executed after the pressure calculated by the pressure calculating section satisfied the predetermined condition, the controller controls the pressure applying section to make the jetting amount of the jetting head for the predetermined time period be a second jetting amount which is greater than the first jetting amount.

According to such arrangement, since the jetting amount for the predetermined time period is limited to the first jetting amount when the pressure in the channel unit satisfied the predetermined condition, it is possible to prevent an occurrence of the under refilling phenomenon by the duty limiting. Further, when the flushing is to be executed after the predetermined condition is satisfied, since the jetting amount for the predetermined time period is made to be the second jetting amount which is greater than the first jetting amount, it is possible to complete the recording earlier than the case in which the jetting amount for the predetermined time is limited to the first jetting amount. In other words, it is possible to suppress the recording speed as a whole from being lowered. Note that, the "flushing" in the present teaching is a concept which includes a non-jetting flushing (making vibrate a meniscus formed in the nozzle to an extent that liquid droplets are not jetted).

As it is clear from the abovementioned description, according to the present invention, it is possible to suppress a decrease in the recording speed while preventing an occurrence of the under refilling phenomenon.

DETAILED DESCRIPTION OF THE PREFERRED EMBODIMENTS

An embodiment according to the present invention will be described below by referring to the accompanying diagrams. In the following description, a direction of jetting an ink from a jetting head is let to be a downward direction and an opposite direction thereof is let to be an upward direction.

Figure 1:
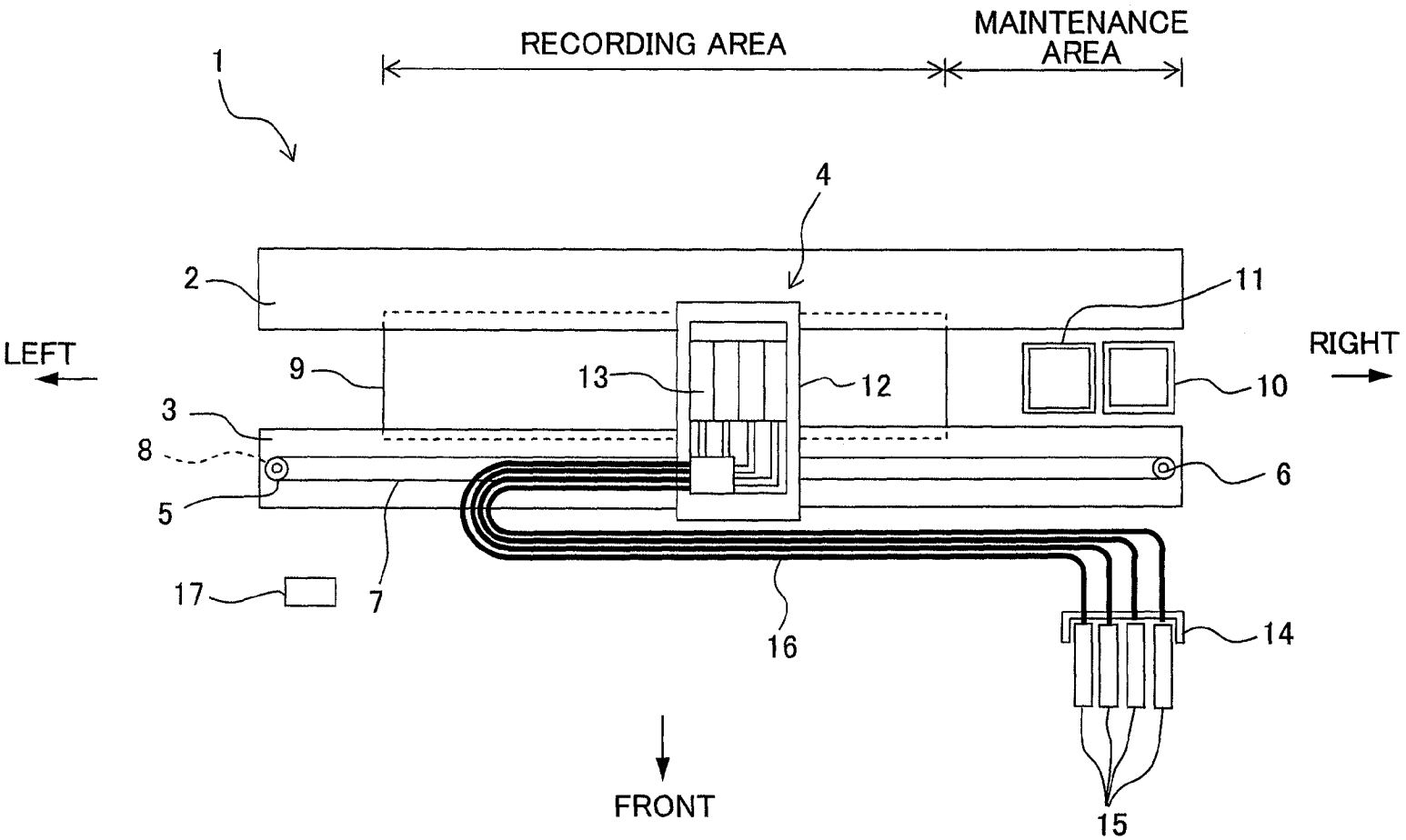
FIG. 1 is a schematic plan view of an ink-jet printer according to an embodiment of the present invention.

As shown in FIG. 1, an ink-jet printer 1 as an example of a liquid droplet jetting apparatus has a pair of guide rails 2 and 3 arranged to be substantially parallel, and a carriage unit 4 is slidably supported in a left-right direction (scanning direction) by the guide rails 2 and 3. The carriage unit 4 is connected to a timing belt 7 which is put around a pair of pulleys 5 and 6, and the timing belt 7 is arranged to be substantially parallel to a direction in which the guide rail 3 extends. The pulley 5 is provided with a carriage motor 8 as a scanning section which drives by rotating in a normal and a reverse direction. By the pulley 5 being driven and rotated in the normal and reverse direction, the timing belt 7 reciprocates, and the carriage unit 4 is scanned along the guide rails 2 and 3.

An area in which the carriage unit 4 reciprocates includes a recording area in which image recording on a recording paper (not shown) as a recording medium is carried out, and a maintenance area which is provided on one side of the scanning direction with respect to the recording area and at which image recording is not carried out. A platen 9 which supports a printing paper under the carriage unit 4 is arranged in the recording area. At the time of printing, a jetting head 20, to be described later, which is mounted on the carriage unit 4 reciprocates left and right across the recording area. In the maintenance area, a cap unit 10 and a waste-ink receiving tray 11 are arranged side-by-side at a lower side between the pair of guide rails 2 and 3. In the maintenance area, a purge process of sucking by negative pressure a dried ink from a nozzle 39 (refer to FIG. 3) by sealing a nozzle surface 21*b* (refer to FIG. 2 and FIG. 3) which is a lower surface of the carriage unit 4 with a cap unit 10, and a flushing process of jetting an ink toward the waste-ink receiving tray 11 from the nozzle 39 (refer to FIG. 3) by driving of an actuator 22 (refer to FIG. 2 and FIG. 3) irrespective of jetting operation for image printing are carried out.

The carriage unit 4 has a carriage 12 which is a casing, and the carriage 12 is provided with four buffer tanks 13 which temporarily store the ink. Moreover, a cartridge mounting portion 14 is provided in front of a right side of the guide rail 3. Ink cartridges 15 which store inks of four colors (black, cyan, magenta, and yellow) are detachably mounted on the cartridge mounting portion 14. The ink cartridges 15 mounted on the cartridge mounting portion 14 are connected to the buffer tanks 13 respectively via ink supply tubes 16. A temperature sensor 17 which is capable of detecting an ambient temperature at an interior of the apparatus is arranged inside a casing of the ink-jet printer 1.

Figure 2:
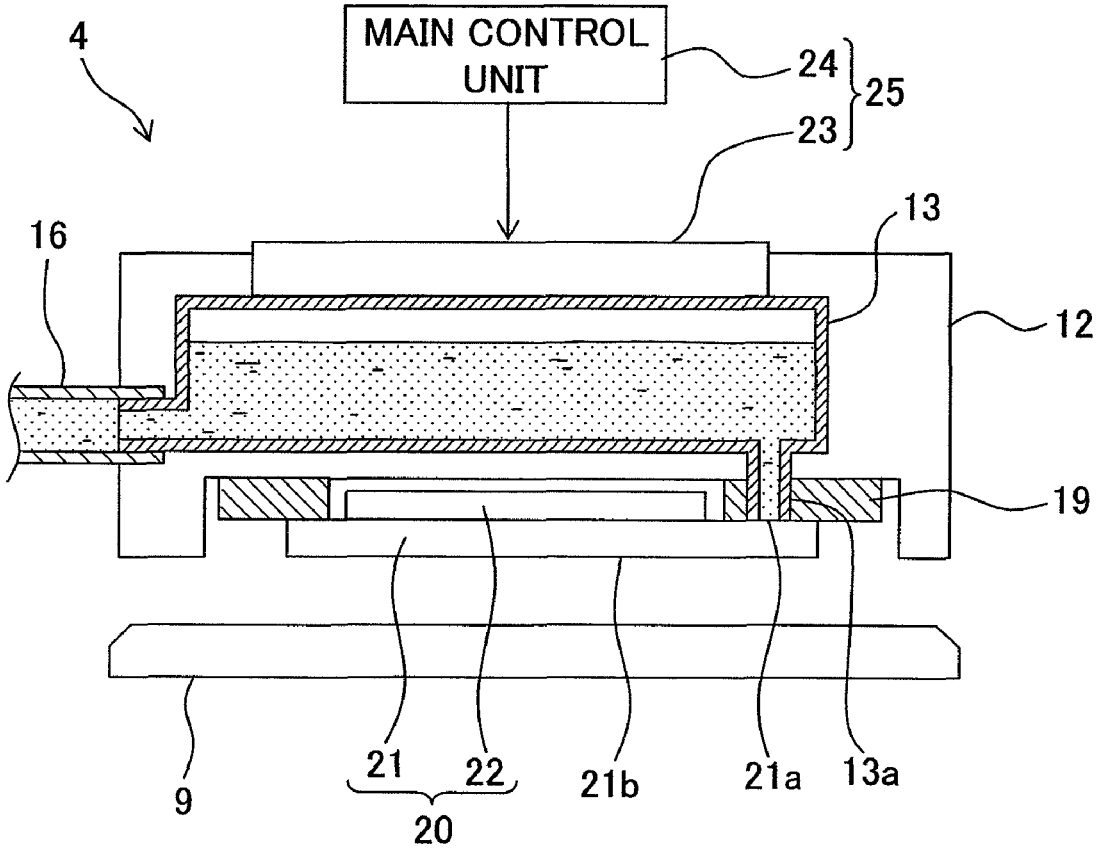
FIG. 2 is a partial cross-sectional view in which a carriage unit of the ink-jet printer shown in FIG. 1 is indicated schematically.

As shown in FIG. 2, the carriage unit 4 includes the buffer tanks 13 which are accommodated in the carriage 12 which is a casing. Moreover, the jetting head 20 is installed at a lower portion of the carriage 12 via a reinforcing frame 19 in the form of a frame plate. An outflow channel 13*a* of the buffer tank 13 communicates with an inflow port 21*a* of the jetting head 20. A filter (not shown in the diagram) for filtering foreign matters in the ink is provided to the inflow port 21*a* of the jetting head 20.

The jetting head 20 includes a channel unit 21 having a plurality of channels 40 guiding the ink from the inflow port 21*a* up to the large number of nozzles 39 (refer to FIG. 3) in the lower surface 21*b* as the nozzle surface, and an actuator 22 of a piezoelectric drive type as a pressure applying section which selectively applies a jetting pressure directed toward the nozzle 39 to the ink in the channel unit 21 and which is stacked on an upper surface of the channel unit 21. The carriage 12 is provided with a head control unit 23 which is connected to the jetting head 20 via a flexible flat cable 50 (refer to FIG. 3). A main control unit 24 is connected to the head control unit 23. In this embodiment, a control function section which includes the head control unit 23 and the main control unit 24 etc. is collectively called as a control unit 25 or a controller.

Figure 3:
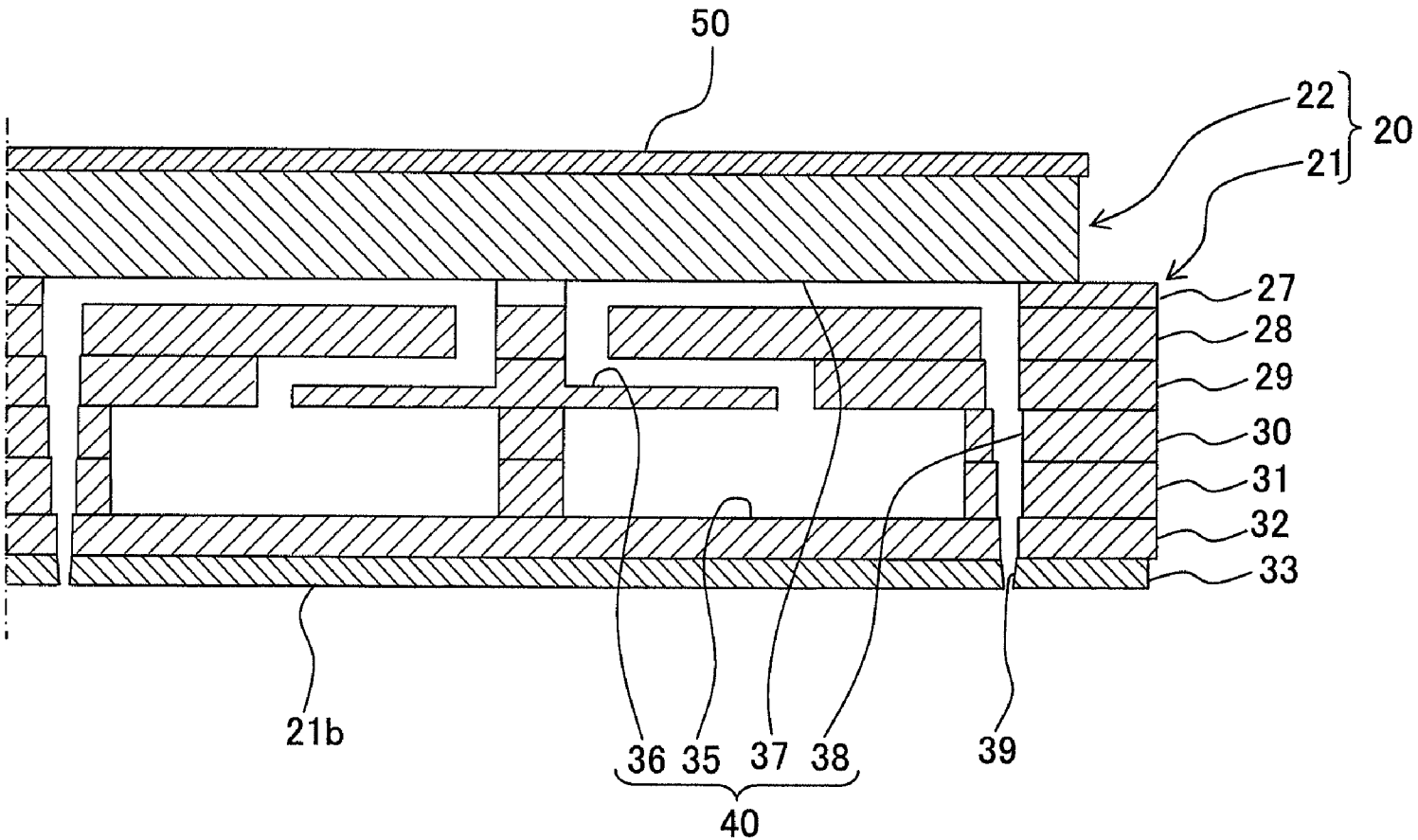
FIG. 3 is a cross-sectional view of main components of a jetting head shown in FIG. 2.

As shown in FIG. 3, the channel unit 21 has a structure in which a plurality of plates 27, 28, 29, 30, 31, 32, and 33 (hereinafter, plates '27 to 33') are stacked. Openings or grooves are formed in the plates 27 to 33, and by stacking the plates 27 to 33, the openings and the grooves communicate, thereby forming channels 40 of inks. The channels 40 of the channel unit 20 include a common liquid chamber 35 which communicates with the inflow port 21*a* (refer to FIG. 2), narrowed passages 36 which are branched in a large number from the common liquid chamber 35, a plurality of pressure chambers 37 facing the actuator 22 and each continuing at a downstream end of one of the narrowed passages 36, a plurality of outflow channels 38 each of which makes one of the pressure chambers 37 communicate with one of the nozzles 39 formed in the lower surface 21*b* of the channel unit 21.

The actuator 22 includes a common electrode, a plurality of individual electrodes, and a plurality of piezoelectric layers not shown in the diagram, and the individual electrodes and the common electrode are connected to the head control unit 23 via the flexible flat cable 50 etc. In the jetting head 20 having such structure, the actuator 22 protrudes toward the pressure chambers 37 according to a driving signal, and the ink inside the pressure chambers 37 is jetted to the outside from the nozzles 39 through the ink outflow channel 38.

Figure 4:
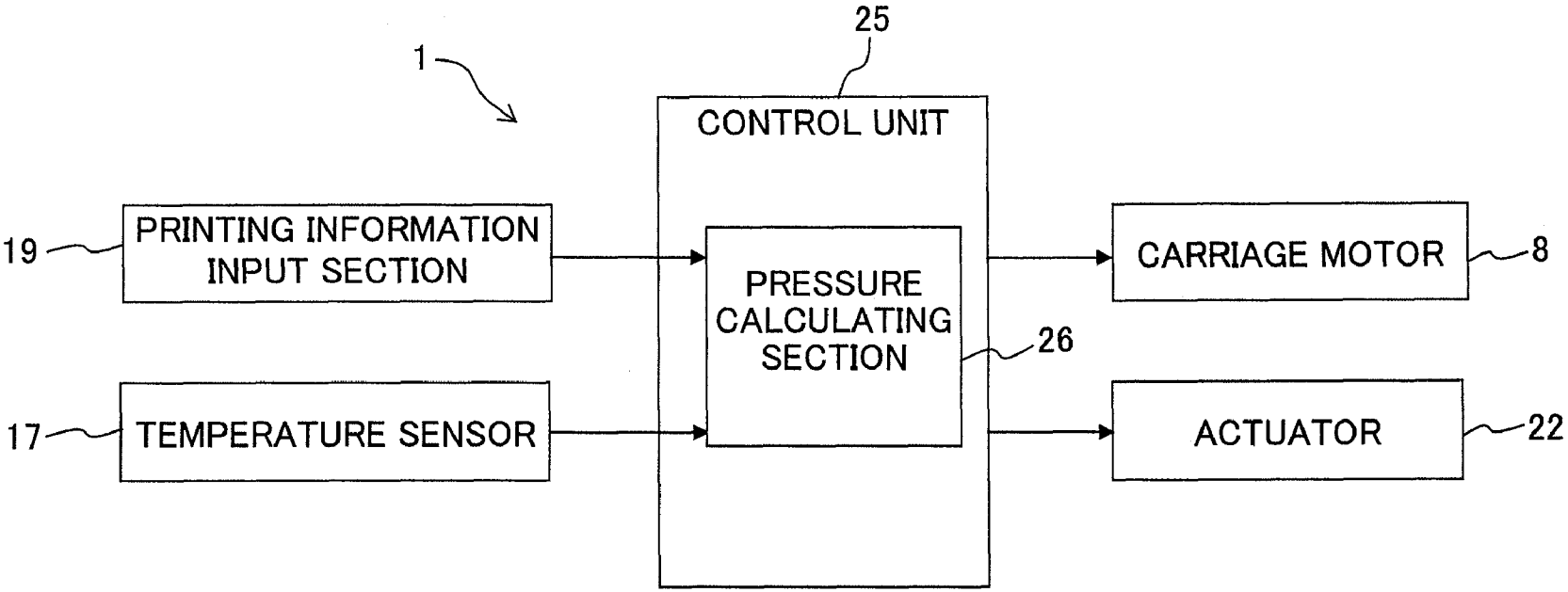
FIG. 4 is a functional block diagram of the ink-jet printer shown in FIG. 1.

As shown in FIG. 4, the control unit 25 includes a pressure calculating section 26, and information from a printing-information input section 19 and information from the temperature sensor 17 are inputted into the pressure calculating section 26. The pressure calculating section 26 calculates a pressure of the ink inside the jetting head 20 based on the information from the printing-information input section 19 and the temperature sensor 17. Image information to be printed on a recording paper is inputted to the printing-information input section 19. An interface which receives image information from a computer connected to the ink-jet printer 1, or a scanner which is provided to the ink-jet printer 1 can be cited as examples of the printing-information input section 19. Moreover, control instructions are outputted to the carriage motor 8 and the actuator 22 from the control unit 25.

Figure 5:
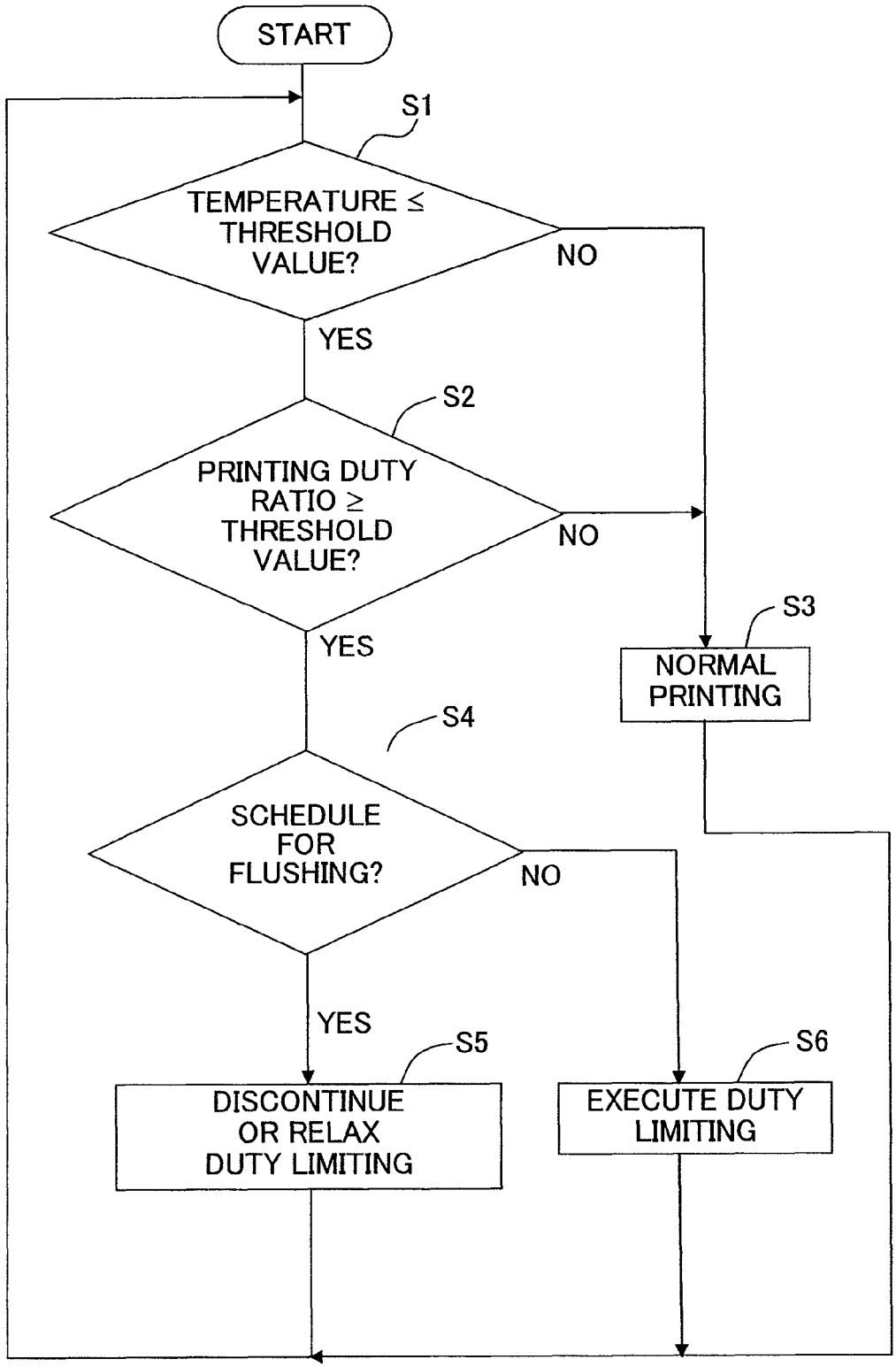
FIG. 5 is a flow chart describing a control of the ink-jet printer shown in FIG. 4.

As shown in FIG. 5, firstly, the control unit 25 of the ink-jet printer 1 makes a judgment of whether or not a temperature detected by the temperature sensor 17 is not higher than a predetermined threshold value (step S1). In this embodiment, the temperature sensor 17, in order to find the temperature of the ink used in the ink jet printer 1, detects an ambient temperature at the interior of the ink-jet printer 1 as mentioned above. A viscosity of the ink, in general, is associated with the temperature of the ink, and as the temperature of the ink decreases, the viscosity of the ink becomes high. Moreover, when a channel area and a flow rate of the ink is constant, as the viscosity of the ink becomes high, the ink does not flow smoothly, and a pressure of the ink inside the jetting head 20 becomes high. Therefore, in this embodiment, the ambient temperature at the interior of the ink-jet printer 1, which is detected by the temperature sensor 17, is used for judging the pressure of the ink inside the jetting head 20. In the step S1, when the temperature detected by the temperature sensor 17 is higher than the predetermined threshold value, the control unit 25 carries out a normal printing with a standard printing speed (step S3).

Whereas, in step S1, when the temperature detected by the temperature sensor 17 is not higher than the predetermined threshold value, the pressure calculating section 26 in the control unit 25 makes a judgment of whether or not a printing duty ratio of the printing information, which has been inputted from the printing-information input section 19, is not lower than a threshold value, for each scanning pass, or in other words, for each one-way movement in the scanning direction from one end to the other end or from the other end to one end of the recording area of the jetting head 20 (step S2). Concretely, the pressure calculating section 26 makes a judgment of whether or not the printing duty ratio of the scanning pass immediately before is not lower than a predetermined threshold value, for each one-way movement of the jetting head 20 in the scanning direction from one end to the other end (from the other end to the one end) of the recording area. The printing duty ratio to be referred to in step S2 may not be a printing duty ratio in the scanning pass immediate before (in the previous scanning pass), and for instance, may be a printing duty ratio of the scanning pass to be scanned subsequently which is calculated in advance based on the printing information from the printing-information input section 19.

In step S2, when the printing duty ratio is lower than the threshold value (Step S2: NO), it may be considered that the amount of ink used for printing is not large, and a negative pressure of the ink inside the jetting head 20 is also not substantial (high). Therefore, the control unit 25 carries out the normal printing at the standard printing speed without restoring the negative pressure of the ink in the jetting head 20 (step S3). Whereas, in step S2, when the printing duty ratio is not lower than the threshold value (Step S2: YES), it may be considered that the amount of ink used for printing is large, and a negative pressure of the ink inside the jetting head 20 is also substantial. Therefore, the control unit 25 makes a judgment of whether or not there is a schedule for executing a flushing function in which the actuator 22 is driven after the jetting head 20 is moved outside the recording area, within a time in which the jetting head 20 scans the recording area for a predetermined number of times from that point of time, or in other words, within a predetermined number of passes (Step S4). The flushing function may be set in advance in the control unit 25 so as to be carried out whenever the jetting head 20 scans the recording area for the predetermined number of times, or the control unit 25 may include a counter (not shown in the diagram) which counts the number of times for which the jetting head 20 has scanned during the time from the previous flushing function has been executed and until the present time. In this case, the control unit 25 is capable of calculating the number of scans to be carried out till the flushing function is executed subsequently, based on a predetermined number of scans which are set in advance, and the number of times for which the jetting head 20 has scanned after executing the previous flushing function till the current time, which has been counted by the counter.

Moreover, in Step S4, when there is not a schedule for the flushing function to be executed during the time when the jetting head 20 scans the recording area for the predetermined number of times, in other words, when the number of scans to be carried out until the next flushing function is carried out is more than the predetermined number of times (Step S4: NO), the control unit 25 executes a duty limiting function in accordance with a standard setting (Step S6). In other words, the control unit 25 limits the jetting amount of the jetting head 20 for a predetermined time period to a first jetting amount. The duty limiting function is a function of generating a waiting time by the control unit 25 by controlling the carriage motor 8 such that the jetting head 20 is stopped temporarily outside the recording area, during the recording operation of forming an image by jetting ink onto a recording paper by the jetting head 20 while reciprocating across the recording area, and a standard setting of the time for stopping temporarily in this case is determined in advance. By executing the duty limiting function as per the standard setting, it is possible to prevent an occurrence of the under refilling phenomenon.

Whereas, in step S4, when there is a schedule of the flushing function being executed during a time when the scanning passes are not more than the predetermined number of times, in other words, when the number of scanning to be carried out till the flushing function is executed subsequently is not more than the predetermined number of times (Step S4: YES), the control unit 25 controls the pressure applying section not to execute the duty limiting function or to relax the limit of the jetting amount (step S5). In other words, the control unit 25 makes the jetting amount of the jetting head 20 for the predetermined time period to a second jetting amount which is greater than the first jetting amount. This is based on a finding described below. Namely, when the flushing function is executed, by the jetting head 20 moving up to an upper side of the waste-ink receiving tray 11 (refer to FIG. 1) which is outside the recording area, a period during which the jetting head 20 does not jet ink is generated. As a result, since the amount of jetting of the jetting head per predetermined time decreases, even when the duty limiting function which is set in advance is discontinued or relaxed, the under refilling phenomenon hardly occurs. Moreover, since the amount of ink jetted from the jetting head 20 at the time of executing the flushing function is less than an amount of ink which is jetted at the time of image recording, even when the flushing function is executed, there is a less effect on restoring of the negative pressure inside the jetting head, and even the time during which the flushing function is executed can be used for restoring the negative pressure inside the jetting head 20. Concretely, the control unit 25 eliminates the waiting time of temporarily stopping the jetting head 20 outside the recording area, or makes the waiting time shorter than a standard set time. In other words, when the waiting time is let to be $T_w$, the standard set time is let to be $T_{st}$, and a reduced time is let to be $T_r$, when a judgment is made to be "YES" at Step S3, the waiting time is determined by the following numerical expression.

$$T_w = T_{st} - T_r \text{ (where, } 0 < T_r \leqq T_{st})$$

In this manner by decreasing or making zero the waiting time $T_w$, it is possible to suppress the speed of the recording operation from decreasing as a whole. Here, by setting the reduced time $T_r$ such that as the number of scanning passes, during a time period from the point of time at which an affirmative judgment is made at Step S2 and until the flushing function is executed, decreases, the reduced time $T_r$ is set to be longer, it is possible to facilitate both, preventing the occurrence of the under refilling phenomenon and suppressing the decrease in the recording speed, and therefore it is suitable.

As an example of the duty limiting function of the embodiment, a case in which the jetting head 20 is temporarily stopped outside the recording area has been explained. However, it may be another mode provided that it is a case in which the amount of ink jetted per predetermined unit time is reduced. For example, a control of limiting the number of nozzles to be used out of all the nozzles 39 of the jetting head 20, or a control of making a time interval of ink jetting long by changing a frequency of driving the actuator 22 may be carried out. Moreover, in this embodiment, conditions of steps S1 and S2 have been used as limiting conditions which are trigger for executing the duty limiting function. However, other conditions such as an ink pressure may be used. Moreover, the flushing function of step S4 may be let to include a case of non-jetting flushing (making vibrate the meniscus in the nozzle 39 by driving the actuator 22, to an extent that the ink is not jetted).

In the embodiment, the setting has been made in advance in the control unit 25 such that the flushing function is executed whenever the jetting head 20 is scanned for the predetermined number of times. However, the timing of executing the flushing function is not restricted to the number of scans of the jetting head 20, and may be set according to a time elapsed from the previous flushing for example. In this case, the control unit 25 may make a judgment of whether or not the subsequent flushing is executed within the predetermined time in step S4 of the embodiment upon counting the time elapsed from the previous flushing, or in other words, the control unit 25 may make a judgment of whether or not the time until the next flushing to be carried out is within the predetermined time.

Figure 6:
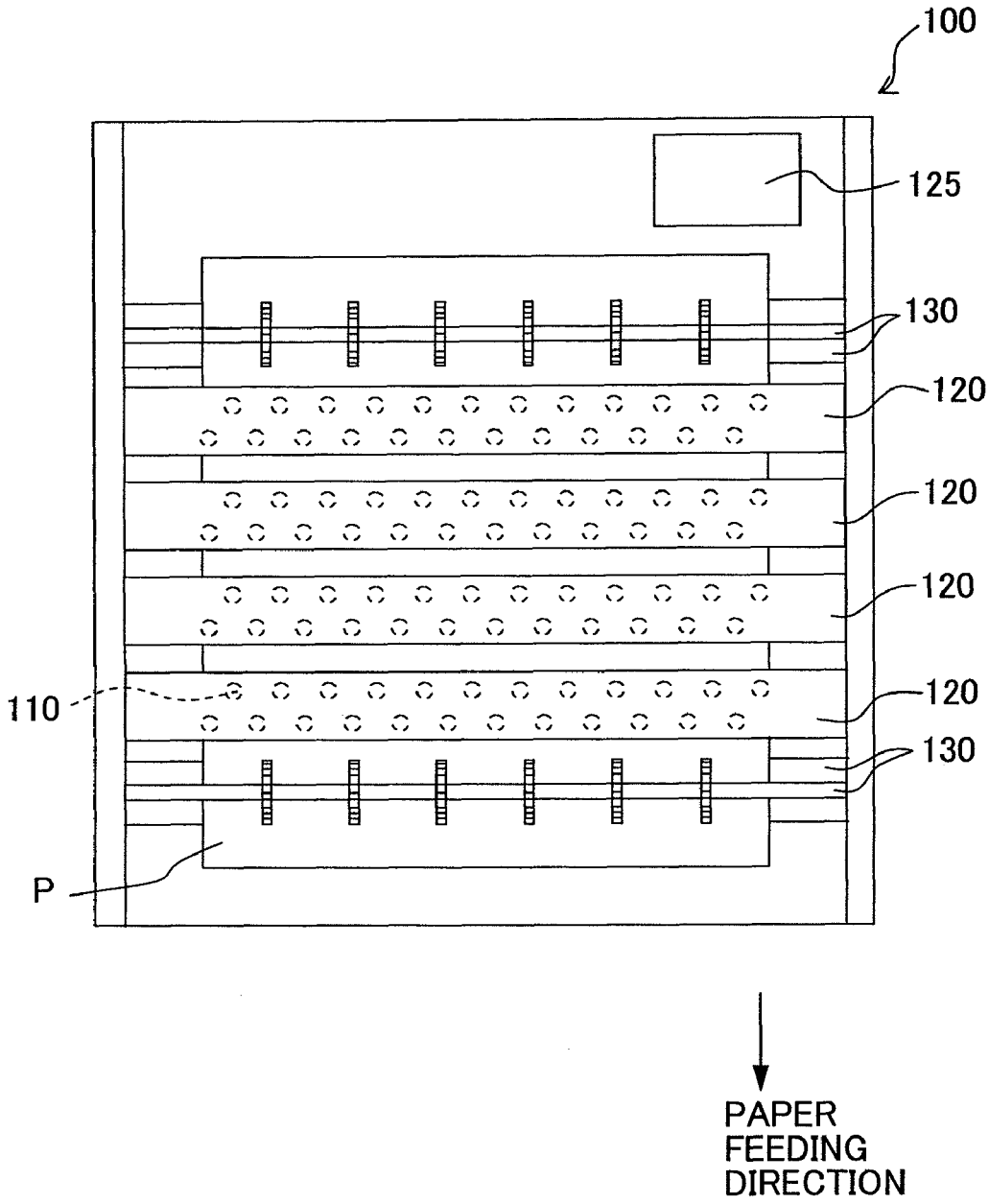
FIG. 6 is schematic structural view of an ink-jet printer according to another embodiment.

This embodiment is an example in which the present teaching is applied to a so-call serial printer in which the ink is jetted while reciprocating the jetting head in the scanning direction together with the carriage unit 4. However, the present teaching is also applicable to a printer other than the serial printer. For example, as shown in FIG. 6, the present teaching is also applicable to a line ink-jet printer which includes four so-called line jetting heads 120 each of which extends in a width direction of an ink-jet printer 100 in the form of a box, and which are fixed to the ink jet printer 100. These four line jetting heads 120 jet inks of black, yellow, cyan, and magenta colors respectively from a plurality of nozzles 110 formed in a lower surface thereof, in order from the one arranged at an upper side respectively in FIG. 6. Transporting rollers 130 are arranged at an upper side and a lower side of the four ink jet heads 120 in FIG. 6, sandwiching the four ink jet heads 120, and transport a recording paper P downward (paper feeding direction) in FIG. 6. Moreover, in the ink-jet printer 100, printing is carried out on the recording paper P by jetting inks from nozzles 110 of the four line jetting heads 120 onto the recording paper P which is transported in the paper feeding direction by the transporting rollers 130.

In this manner, even in the line-type ink-jet printer 100, a control unit 125, similarly as the control in the embodiment, is capable of controlling the execution of the duty limiting function based on an ambient temperature inside the ink-jet printer 100, printing duty ratio of printing information which is inputted from the printing-information input section, and whether there is a schedule for execution of the flushing function. In the embodiment, the control unit 25 has been making the judgment of whether or not the printing duty ratio is not lower than the threshold value for each scanning pass. However, in the line ink-jet printer 100, a judgment of whether or not the printing duty ratio is not lower than the threshold value for each page may be made. Moreover, in the embodiment, the setting has been made to execute the flushing function for each of predetermined number of scans or each of the predetermined times. However, in the line ink-jet printer 100, the setting may be made to execute the flushing function whenever predetermined number of pages is printed. Moreover, the flushing may be carried out by jetting ink in a state of the recording paper P not being interposed, toward a waste-ink receiving tray not shown in the diagram which is arranged at a lower side of the four ink-jet heads 120. Moreover, when the printing duty ratio has surpassed the threshold value, and the number of pages to be printed until the next flushing is executed is not more than the predetermined number of pages, it is possible to suppress the decrease in the recording speed by discontinuing or relaxing the duty limiting function. When the printing duty ratio has surpassed the threshold value, and the number of pages to be printed until the next flushing is more than the predetermined number of pages, by executing the duty limiting function as per the standard setting, it is possible to prevent the occurrence of the under refilling phenomenon. Moreover, in the line ink-jet printer 100, for example, since it is possible to decrease the amount of ink to be jetted within the predetermined time by lowering the speed of transporting the paper P, it is possible to prevent an increase in the negative pressure of the ink. In other words, the duty may be limited by lowering the transporting speed of the paper P.

As it has been described above, a liquid droplet jetting apparatus according to the present invention has a favorable effect of being capable of suppressing the decrease in the recording speed while preventing the occurrence of the under refilling phenomenon, and is useful when widely applied to an ink-jet printer which is capable of exerting the significance of this effect.

What is claimed is:

1. A liquid droplet jetting apparatus which jets liquid droplets of a liquid onto a recording medium, comprising:

a jetting head having a channel unit in which a plurality of nozzles for jetting the liquid droplets and a plurality of pressure chambers communicating with the nozzles respectively are formed, and a pressure applying section which applies a pressure to the liquid inside the pressure chambers;

a scanning section which reciprocates the jetting head across a recording area of the recording medium; and a controller which is configured to:

include a pressure calculating section which is configured to calculate a pressure in the channel unit;

control the pressure applying section to execute: a duty limiting in which a jetting amount of the jetting head for a predetermined time period is limited to a first jetting amount when the pressure in the channel unit calculated by the pressure calculating section satisfied a predetermined condition; and a flushing in which the pressure applying section is driven irrespective of a jetting operation onto the recording medium; and control the pressure applying section to make the jetting amount of the jetting head for the predetermined time period be a second jetting amount which is greater than the first jetting amount, under a condition that the pressure calculated by the pressure calculating section satisfies the predetermined condition and that the flushing is to be executed after the pressure calculated by the pressure calculating section satisfied the predetermined condition;

wherein before the flushing is executed, the controller is configured to control the scanning section to move the outside the recording area; and wherein the controller is configured to stop driving the pressure applying section while the jetting head being is moved by the scanning section toward outside the recording area before the flushing.

2. The liquid droplet jetting apparatus according to claim 1, further comprising:

a temperature sensor which detects a temperature in the liquid droplet jetting apparatus; and a printing-information input section to which an information of an image to be printed on the recording medium is inputted;

wherein the pressure calculating section calculates pressure in the channel unit based on the temperature detected by the temperature sensor and a printing duty ratio of the information inputted from the printing-information input section.

3. The liquid droplet jetting apparatus according to claim 2;

wherein the jetting head extends in a predetermined direction and is fixed to the liquid droplet jetting apparatus, and the nozzles are aligned in the predetermined direction.

4. The liquid droplet jetting apparatus according to claim 1;

wherein the controller controls the scanning section to execute the duty limiting such that the jetting head is stopped temporarily at a position outside the recording area and a waiting time is generated during a jetting operation on the recording medium by the jetting head; and wherein, when the flushing is to be executed after the predetermined condition has been satisfied, the controller does not execute the duty limiting, or executes the duty limiting such that the waiting time generated by the duty limiting becomes shorter.

5. The liquid droplet jetting apparatus according to claim 4;

wherein when a number of times for which the jetting head scans the recording area, during a time period after the predetermined condition is satisfied and until the flushing is executed, is not more than a predetermined number of times, the controller makes the jetting amount of the jetting head for the predetermined time period be the second jetting amount until the flushing is executed.

6. The liquid droplet jetting apparatus according to claim 5;

wherein the controller judges whether or not the printing duty ratio of the information inputted from the printing-information input section is not lower than a predetermined threshold value for each scanning pass which is one-way movement of the jetting head across the recording area; and wherein, when a number of times for which the jetting head scans the recording area, from a scanning pass at which the predetermined condition is satisfied until the flushing is executed, is not more than the predetermined number of times, the controller makes the jetting amount of the jetting head for the predetermined time period be the second jetting amount until the flushing is executed.

7. The liquid droplet jetting apparatus according to claim 1;

wherein when the predetermined condition is satisfied, the controller controls the jetting head such that the liquid droplets are not jetted from a part of nozzles, among the plurality of nozzles which are capable of jetting the liquid droplets onto the recording medium.

8. The liquid droplet jetting apparatus according to claim 1;

wherein the controller inputs, to the pressure applying section, a pulse signal for jetting the liquid droplets from the nozzles of the jetting head;

wherein the pulse signal includes a first pulse signal, and a second pulse signal of which frequency is smaller than a frequency of the first pulse signal;

wherein, when the predetermined limiting condition is not satisfied, the controller inputs the first pulse signal to the pressure applying section; and wherein, when the predetermined limiting condition is satisfied, the controller inputs the second pulse signal to the pressure applying section.

9. The liquid droplet jetting apparatus according to claim 1;

wherein meniscuses formed in the nozzles are recovered while the jetting head is moved by the scanning section toward outside the recording area without driving the pressure applying section before the flushing.

* * * * *